US008430243B2

(12) United States Patent
Quehl

(10) Patent No.: US 8,430,243 B2
(45) Date of Patent: Apr. 30, 2013

(54) CABLE ORGANIZATION SYSTEM AND METHOD OF SECURING A CABLE THEREIN

(75) Inventor: Luis Quehl, Santa Rosa, CA (US)

(73) Assignee: DayMen Canada Acquisition ULC, Vancouver (CA)

( * ) Notice: Subject to any disclaimer, the term of this patent is extended or adjusted under 35 U.S.C. 154(b) by 80 days.

(21) Appl. No.: 13/030,685

(22) Filed: Feb. 18, 2011

(65) Prior Publication Data

US 2011/0203959 A1 Aug. 25, 2011

Related U.S. Application Data

(60) Provisional application No. 61/306,438, filed on Feb. 19, 2010.

(51) Int. Cl.
*B65D 85/86* (2006.01)

(52) U.S. Cl.
USPC ..... 206/702; 206/388; 206/481

(58) Field of Classification Search ..... 206/303, 206/388, 49, 481, 702; 242/470, 588; 53/430
See application file for complete search history.

(56) References Cited

U.S. PATENT DOCUMENTS

| | | | | |
|---|---|---|---|---|
| 1,705,050 | A * | 3/1929 | Taylor | 206/388 |
| 2,167,926 | A | 6/1937 | Glasker | |
| 2,674,288 | A * | 4/1954 | Laidlaw | 190/115 |
| 2,937,728 | A | 5/1958 | Koffler | |
| 4,319,703 | A * | 3/1982 | Gann | 223/106 |
| 4,640,032 | A | 2/1987 | Lewis | |
| 4,662,517 | A * | 5/1987 | Wirth | 206/388 |
| 4,880,315 | A | 11/1989 | Berry et al. | |
| 5,129,514 | A * | 7/1992 | Lilley, Jr. | 206/388 |
| 5,579,916 | A | 12/1996 | Manko | |
| 6,026,961 | A | 2/2000 | McCarthy et al. | |
| 7,098,406 | B1 | 8/2006 | Hammonds | |
| 7,226,290 | B2 * | 6/2007 | Nickol | 434/95 |
| 2006/0121962 | A1 | 6/2006 | Kohli | |
| 2007/0044877 | A1 | 3/2007 | Davidoff et al. | |
| 2007/0138050 | A1 | 6/2007 | Dominey | |

OTHER PUBLICATIONS

Bucket Boss 06100 Cable and Tool Bag, www.amazon.com, Date Unknown.

Think Tank Cable Management 20, Organizer Pouch, www.amazon.com Date Unknown.

"International Search Report and Written Opinion", Application No. PCT/US2011/025456, mailed Apr. 12, 2011.

* cited by examiner

*Primary Examiner* — David Fidei
(74) *Attorney, Agent, or Firm* — Medler Ferro PLLC

(57) ABSTRACT

A cable organization system for storing one or more cables may include a case or housing, with one or more loops formed on an inner surface thereof. A middle portion of a removable tab is resiliently retained within each loop, with end portions of the tab protruding outside the loop. A first cable end is tucked within the loop, and the length of the cable is repeatedly wound around the loop and tucked behind end portions of the tab until the length of cable is spent. The second end of the cable may also then be tucked within the loop, or between windings of the coiled cable, to secure the cable for storage. When it is desired to remove the cable from the cable organization system, the tab may simply be removed to quickly release the cable or the cable may be unwound leaving the tab in place.

14 Claims, 7 Drawing Sheets

CABLE ORGANIZATION SYSTEM AND METHOD OF SECURING A CABLE THEREIN

CROSS-REFERENCE TO RELATED APPLICATIONS

This application is a non-provisional application claiming the benefit under 35 U.S.C. §119(e) of U.S. Provisional Patent Application No. 61/306,438 filed Feb. 19, 2010, which is hereby incorporated by reference in its entirety herein.

FIELD OF THE INVENTION

The invention is related to an apparatus and method for organizing and storing one or more flexible elongated structures such as cables therein.

BACKGROUND OF THE INVENTION

Electronic and other devices such as cameras, cellular phones, personal digital assistants (PDAs), notebook computers, netbooks, smartphones, etc, require an array of elongated flexible products such as cables. These may include, but are not limited to, electrical cables, A/C adapter cables, audio visual adapter cables, USB adapter cables and other cables known to those skilled in the art. Neatly storing these cables for access or transport can be difficult. Often, users simply wind each cable into an individual coil and store one or more coiled structures in a receptacle such as a bag or box. However, the coiled structures often begin to shift and unravel in storage, especially when being transported or relocated. Further, when multiple coiled structures are present in the storage bag or box, the cables become entangled with each other. It is accordingly an object hereof to provide an apparatus for neatly storing one or more cables. It is also an object hereof to provide an apparatus that allows the cable to be quickly and easily removed therefrom.

BRIEF SUMMARY OF THE INVENTION

Embodiments hereof relate to a cable organization system for storing one or more elongated flexible structures such as cables. The cable organization system includes a housing with one or more loops formed on a surface thereof. A middle portion of a removable tab is resiliently retained within each loop, with end portions of the tab protruding outside the loop. To store a cable within the cable organization system, a first cable end is tucked within the loop and the length of the cable is repeatedly wound around an exterior surface of the loop, with portions of the cable tucked behind the end portions of the tab, until the length of cable is spent. The second end of the cable may also then be tucked within the loop, or between windings of the coiled cable, to secure the cable for storage. When it is desired to remove the cable from the cable organization system, the tab may simply be removed to quickly release the cable or the cable may be unwound leaving the tab in place.

BRIEF DESCRIPTION OF DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention. The drawings are not to scale.

DETAILED DESCRIPTION OF THE INVENTION

Specific embodiments of the present invention are now described with reference to the figures, wherein like reference numbers indicate identical or functionally similar elements. The following detailed description is merely exemplary in nature and is not intended to limit the invention or the application and uses of the invention. Although the description of the invention is in the context of securing cables for electronic devices, the invention may also be used to secure other devices as it is deemed useful. Furthermore, there is no intention to be bound by any expressed or implied theory presented in the preceding technical field, background, brief summary or the following detailed description.

Figure 1:
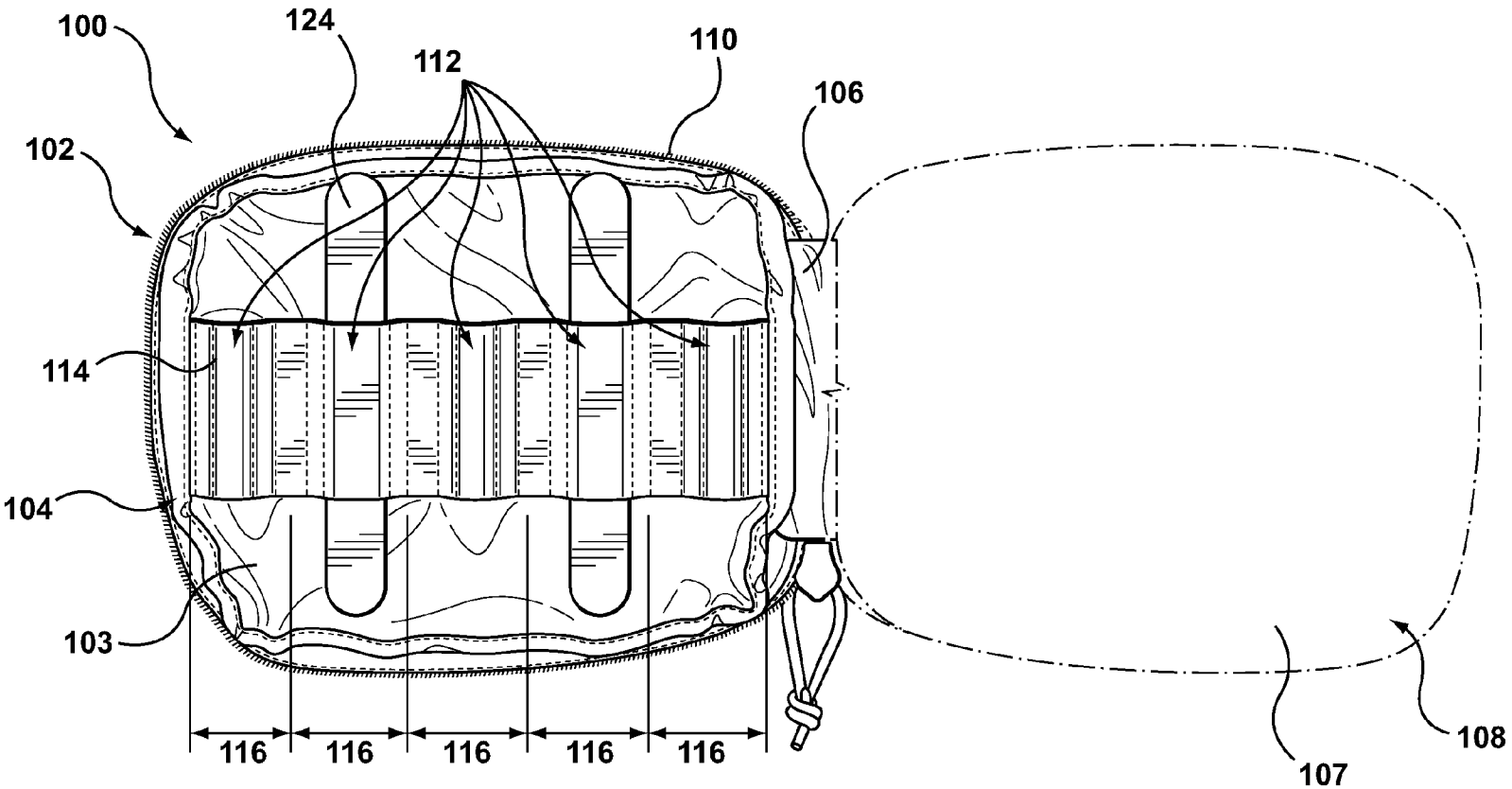
FIG. 1 is a schematic illustration of a cable organization system for storing one or more cables therein according to an embodiment hereof.

Embodiments hereof relate to a cable organization system 100 for winding and storing one or more elongated flexible products such as cables. Although described herein as a system for storing cables, it will be understood by those of ordinary skill in the art that cable organization system 100 may be utilized for storing various elongated flexible products including cables, wires, ropes, twine, and the like. Referring to FIG. 1, cable organization system 100 includes a housing 102. Housing 102 may be a backpack, storage bag, sling bag, rolling case, belt pack, tote, notebook case, cover, case, display panel, or have another accessory configuration. Housing 102 may be used to store/transport cameras, phones, GPS Devices, computers, or other devices or accessories, or used to store primarily cables. In the embodiment depicted in FIG. 1, housing 102 includes a first panel 104 connected to a second panel 108 (shown in phantom in FIG. 1) via a spine 106. First panel 104 of housing 102 has a first outer or exterior surface (not shown in FIG. 1) and a second inner or interior surface 103. Similarly, second panel 108 of housing 102 has a first outer or exterior surface (not shown in FIG. 1) and a second inner or interior surface 107. Panels 104, 108 may open and close in clamshell fashion, and a closure mechanism such as a zipper 110 may be provided around the edges of panels 104, 108 for maintaining housing 102 closed. Although shown as a zipper, any mechanism for maintaining housing 102 closed may be utilized including a snap, button, hook and loop fastener, magnetic attraction, or other mechanical method. In FIG. 1, housing 102 is laid open to reveal inner surfaces 103, 107 of panels 104, 108, respectively. As will be explained in more detail herein, inner surface 103 of first panel 104 includes at least one loop 112 utilized in storing a cable. Although described herein as utilizing first panel 106 for storing cables, it will be understood by those of ordinary skill in the art that second panel 108 may additionally or alternatively be utilized for storing cables. Further, it will be understood by those of ordinary skill in the art that housing 102 need not include both first and second panels. Housing 102 may include a single panel when for example cable organization system 100 is utilized for storing cables in a display fashion (i.e., the single panel may be configured to hang on a wall for cable storage thereon). Further, as explained above, the housing is merely an example and cable organization system may be used in conjunction with any type of bag, container, case, cover, display, etc.

In one embodiment, housing 102 is formed from a relatively soft or flexible protective material such as canvas, cloth, synthetic leather, leather, tarpaulin, rubber, nylon, neoprene, silicone or the like. Alternatively, housing 102 may be formed from a relatively hard or stiff material including but not limited to cardboard, fiberboard, wood, wood fiber, metal, or a polymer that operates to shield the contents stored within cable organization system 100 from breakage or damage. In one embodiment, housing 102 may be formed from a relatively hard or stiff material and the outer surfaces of panels 104 and 108 may include a covering for aesthetic purposes. The covering may be canvas, cloth, synthetic leather, leather, or tarpaulin. Further, in one embodiment, inner surface 103 of first panel 104 may include an inner lining of a soft, non-scratch material and/or a thin padding of approximately 2-3 mm thickness between the lining and the protective material of first panel 104 to protect the contents stored within cable organization system 100.

One or more loops 112 are formed by a continuous strip or band of material or fabric 114 which is attached at spaced apart intervals 116 to inner surface 103 of first panel 104. Alternatively, multiple shorter segments of fabric may be separately attached at spaced apart intervals 116 to inner surface 103 of first panel 104, with each segment of fabric forming a loop 112. The spacing between loops 112 (i.e., spaced apart intervals 116) may be equal or unequal to each other and may vary according to application. As will be explained in more detail below, the length of a cable is wound around the exterior of a loop 112. When it is desired to store multiple cables within cable organization system 100, the spacing between intervals 116 should be designed to accommodate windings of the cables between adjacent loops and thus the spacing may vary depending on the length and/or size of the cables to be stored within cable organization system 100. In one embodiment, fabric 114 may be a webbing or a strong, woven material of hemp, cotton, or jute. In another embodiment, fabric 114 may be a soft cloth material or a material having elastic properties. Fabric 114 may be attached to inner surface 103 of first panel 104 via stitching 117 (see FIG. 2), or by other any mechanical method including staples, rivets, adhesive, hook and loop fastener, or the like. In the embodiment of FIG. 1, first panel 104 includes five loops 112. However, it will be understood to one of ordinary skill in the art that housing 102 may include any number of loops for storing cables.

Figure 2:
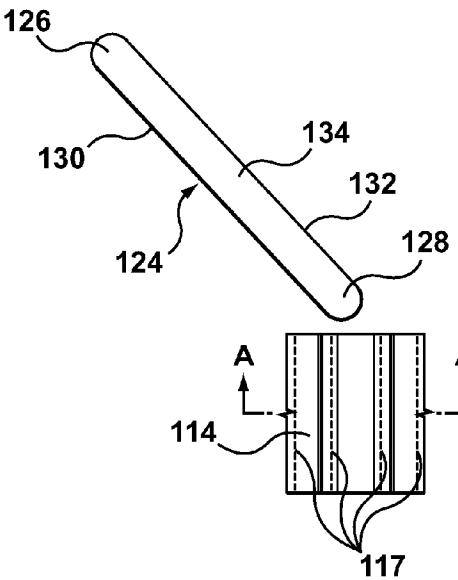
FIG. 2 is a schematic illustration of a loop formed within the cable organization system of FIG. 1, prior to inserting a removable cable winding tab therein.
Figure 2A:
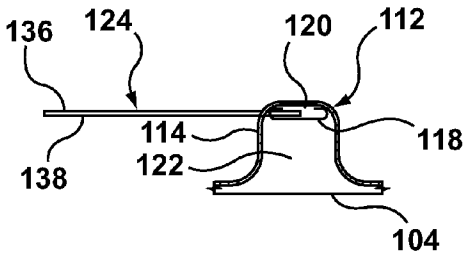
FIG. 2A is a sectional view taken along line A-A of FIG. 2.

Referring now to FIGS. 2 and 2A, a divider or diaphragm 118 is attached to an inner surface of fabric 114 within each loop 112 in order to longitudinally partition the open space defined by loop 112 and first panel 104 into a relatively small slot or sleeve 120 and a relatively large pocket 122. Divider 118 is a small segment of fabric, and may be a material that is the same or different from fabric 114. In one embodiment, divider 118 may be a soft cloth material or a material having elastic properties. Divider 118 may be attached to the inner surface of fabric 114 via stitching 117, or by other any mechanical method including staples, rivets, adhesive, hook and loop fastener, or the like. As will be explained in more detail herein, one or both ends of a cable may be tucked in and stored within pocket 122. The depth of each loop 112, or the distance that each loop 112 extends away from first panel 104, as well as the width of each loop 112 may vary according to application. The depth and width of each loop 112 should be designed to selectively accommodate both ends of a cable and thus may vary depending on the type of cables to be stored within cable organization system 100.

Figure 3:
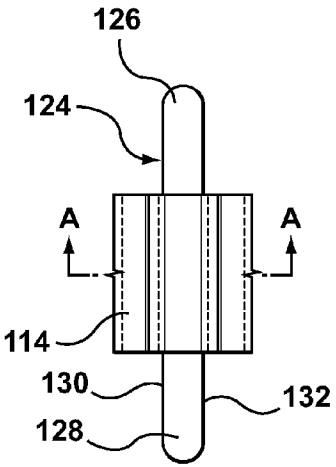
FIG. 3 is a schematic illustration of a loop formed within the cable organization system of FIG. 1, wherein a removable cable winding tab is inserted therein.
Figure 3A:
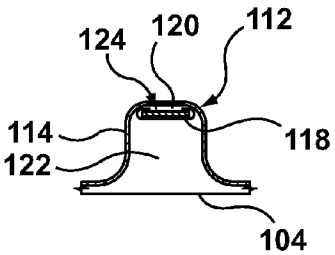
FIG. 3A is a sectional view taken along line A-A of FIG. 3.

A portion of fabric 114 forming loop 112 and divider 118 collectively encircle a removable cable winding tab or spindle 124 to resiliently retain tab 124 within sleeve 120. FIGS. 2-2A are schematic illustrations of loop 112 prior to inserting removable cable winding tab 124 within sleeve 120, while FIGS. 3-3A are schematic illustrations of loop 112 with removable cable winding tab 124 inserted through sleeve 120. Tab 124 is a planar structure having elongated body 134 extending between a first end portion 126 and a second opposing end portion 128. The planar structure of tab 124 further includes a first flat surface 136, a second opposing flat surface 138, a first edge 130 extending longitudinally along elongated body 134, and a second opposing edge 132 extending longitudinally along elongated body 134. Tab 124 is formed from a relatively rigid or stiff material such as a polymer, cardboard, fiberboard, wood, wood fiber, or metal.

Figure 4:
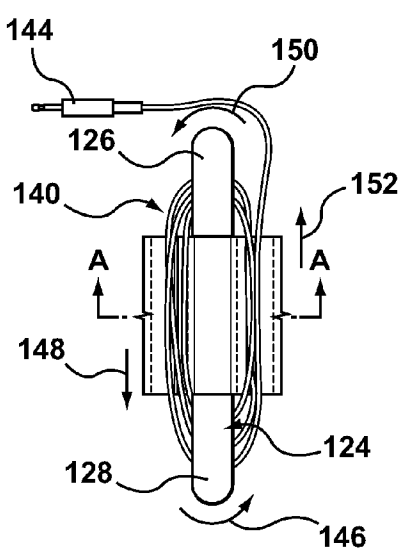
FIG. 4 is a schematic illustration of a loop formed within the cable organization system of FIG. 1, wherein a cable is wound around a removable cable winding tab inserted within the loop.
Figure 4A:
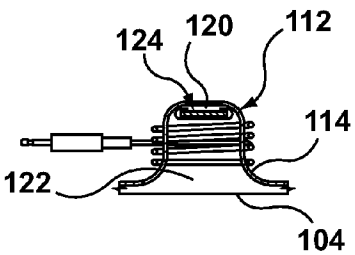
FIG. 4A is a sectional view taken along line A-A of FIG. 4.

When located within sleeve 120, end portions 126, 128 of tab 124 protrude from the edges of loop 112 and diaphragm 118 surrounds a midsection of tab 124 in a snug or tight interference fit such that tab 124 is suspended therein and removably coupled to housing 102 without requiring a mechanical device such as a clip, hinge, or other rigid connection. A pulling force beyond gravity alone is thus required to remove tab 124 from sleeve 120. Referring now to FIGS. 4-4A, a length of a cable 140 is repeatedly wound or wrapped around the exterior surface of loop 112 and under end portions 126, 128 of tab 124 extending beyond loop 112 until the length of cable 140 is exhausted. As will be explained in more detail herein, the ends of cable 140 may be tucked within pocket 122 of loop 112. When it is desired to remove cable 140 from cable organization system 100, tab 124 may simply be pulled or removed from sleeve 120 to quickly release cable 140, or cable 140 may be unwound from tab 124.

It will be understood by those of ordinary skill in the art that cable organization system 100 may include multiple loops, each with a corresponding removable tab for storing a cable. Thus, if it is desirable to store five cables within cable organization system 100, system 100 will include at least five loops and at least five tabs. If a cable organization system is provided with multiple loops and tabs, a user may utilize cable organization system 100 to store a number of cables equal or less than the provided number of loops and tabs.

Figure 5:
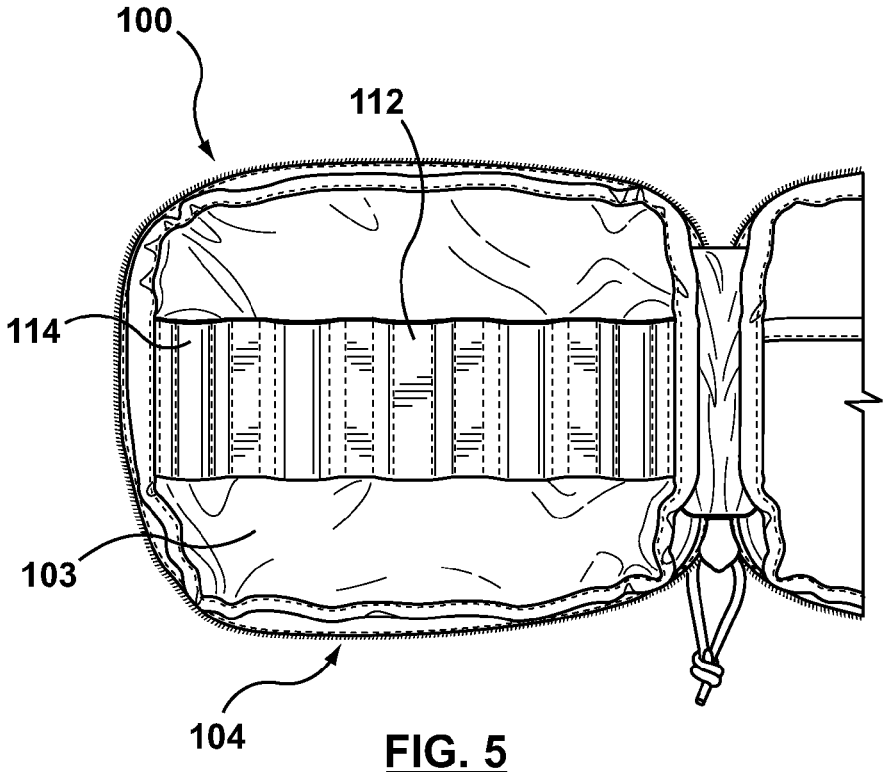
FIGS. 5-13 are schematic illustrations depicting a method of storing a cable within a cable organization system according to an embodiment hereof.
Figure 6:
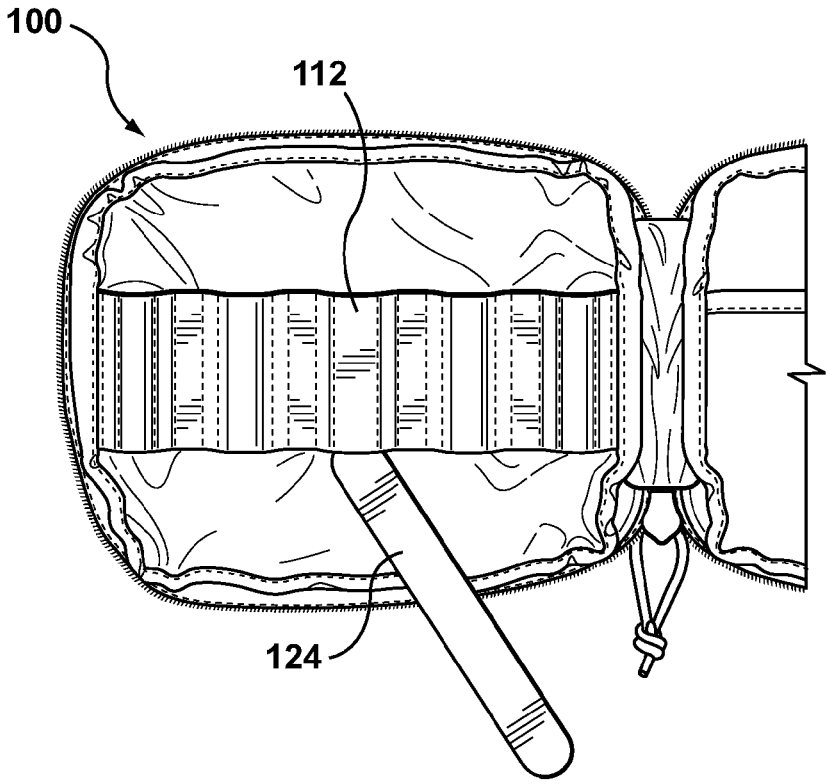
Figure 7:
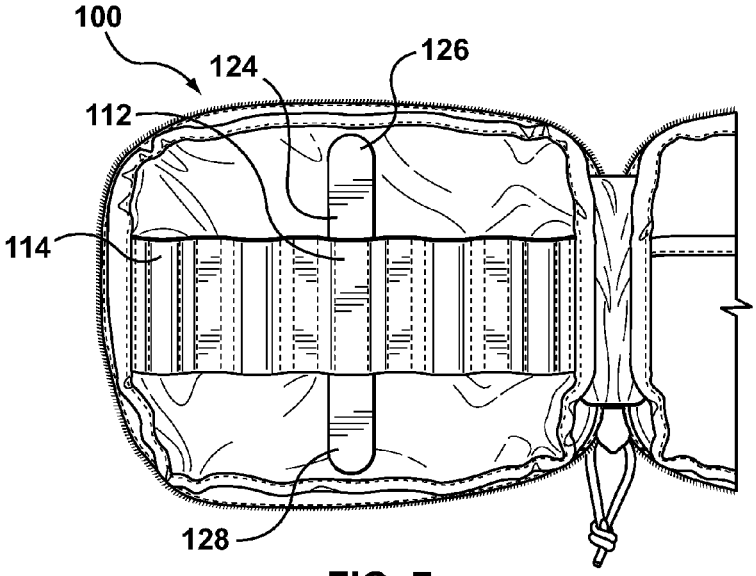

A method of securing cable 140 within cable organization system 100 will now be described in more detail with reference to FIGS. 5-13. FIG. 5 depicts housing 102 laid open to reveal inner surface 103 of first panel 104. As described above, fabric 114 is attached to inner surface 103 of first panel 104 to form multiple loops 112. FIG. 6 depicts tab 124 being inserted into loop 112. Although obscured from view in FIG. 6, tab 124 is inserted into sleeve 120 formed by divider 118 and a portion of fabric 114 of loop 112, as shown in FIGS. 3-3A. Tab 124 is resiliently retained within sleeve 120 such that end portions 126, 128 of tab 124 protrude from the edges of loop 112 as shown in FIG. 7.

Figure 8:
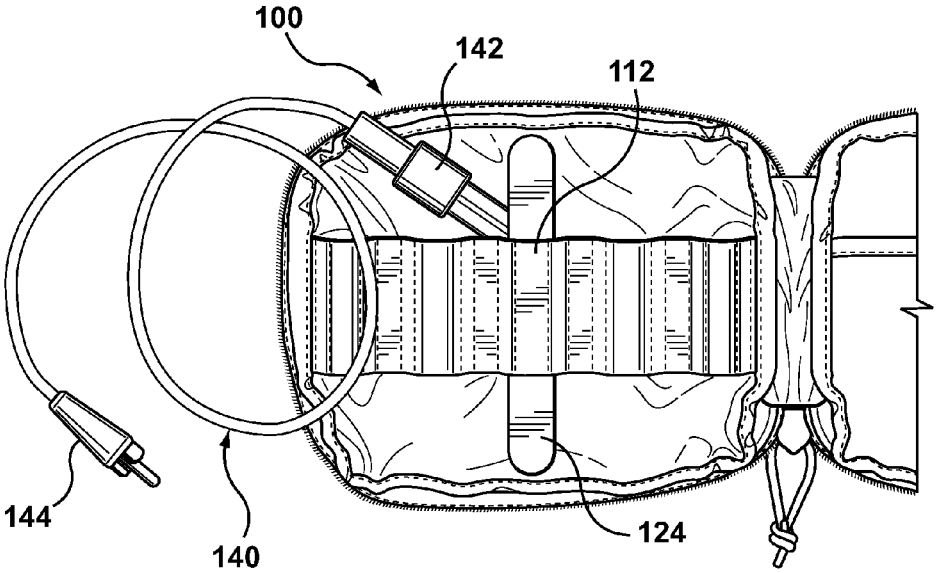
Figure 9:
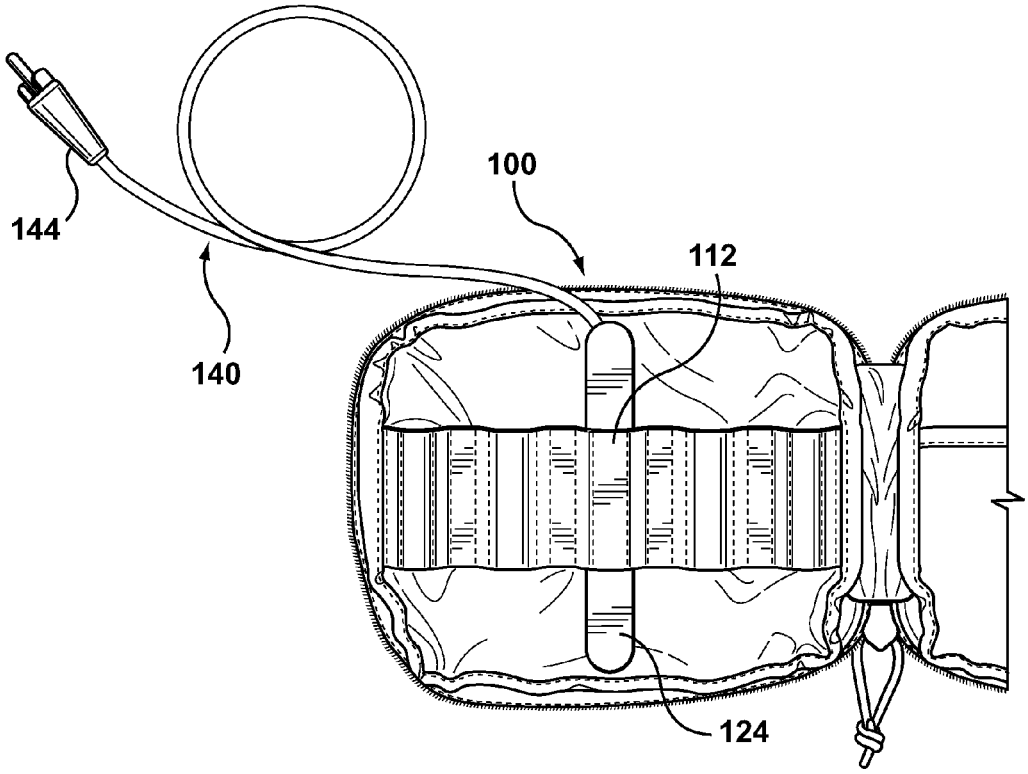
Figure 10:
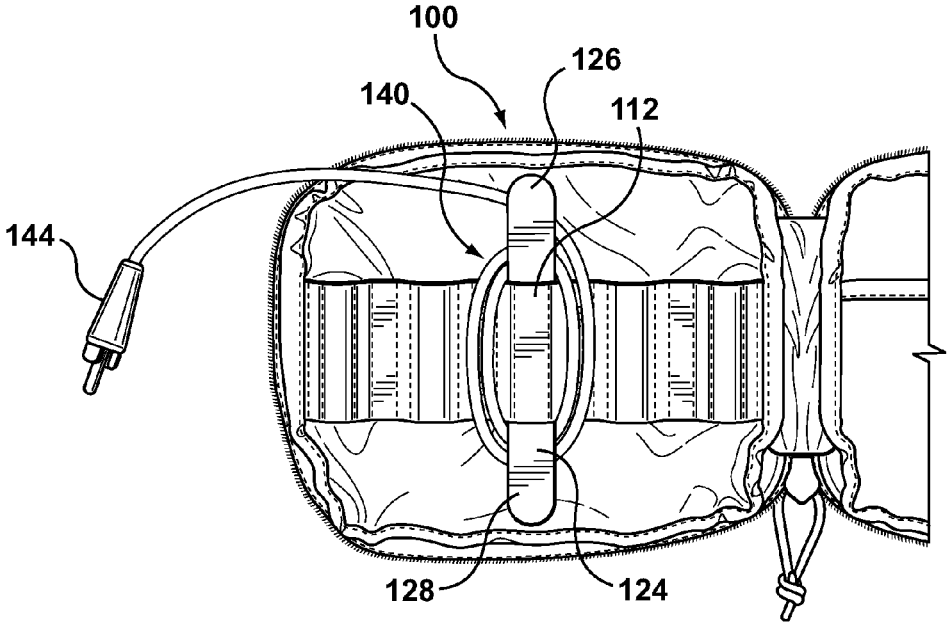

Referring now to FIGS. 8 and 9, in order to store cable 140 within cable organization system 100, a first end 142 of cable 140 is initially tucked or secured within pocket 122 formed by divider 118, surface 103, and the remaining portion of fabric 114 of loop 112. FIG. 8 illustrates the step of inserting first end 142 of cable 140 into loop 112, while FIG. 9 depicts first end 142 secured within pocket 122, behind tab 124.

With first end 142 tucked into pocket 122, a length of a cable 140 is repeatedly wound or wrapped over the outer surface of loop 112 and under end portions 126, 128 of tab 124 until the length of cable 140 is spent. More particularly, with reference to FIGS. 4, 4A and 10, after first end 142 of cable 140 is inserted within pocket 122 behind tab 124, cable 140 is extended over an outside surface of fabric 114 of loop 112 in the direction of arrow 148 in FIG. 4. Cable 140 is then threaded behind and around end portion 128 of tab 124 as indicated by directional arrow 146 such that cable 140 extends between inner surface 103 of first panel 104 and second flat surface 138 of tab 124. Cable 140 then extends over the outside surface of fabric 114 of loop 112, running alongside the right side of loop 112 generally parallel to the portion of tab 124 retained within loop 112 as indicated by directional arrow 152. Cable 140 is then threaded behind and around end portion 126 of tab 124 such that cable 140 extends between inner surface 103 of first panel 104 and second flat surface 138 of tab 124 as indicated by directional arrow 150. Cable 140 then extends over the outside surface of fabric 114, running alongside the left side of loop 112 generally parallel to the portion of tab 124 retained within loop 112 as indicated by directional arrow 148. This cycle is repeated until the length of cable 140 is completely wound around the exterior of loop 112. Since portions of cable 140 were threaded behind end portions 126, 128 of tab 124, tab 124 essentially pins cable 140 against first panel 104 of housing 102 to securely store cable 140 within cable organization system 100. One skilled in the art would recognize that although the method has described winding cable 140 in a counter-clockwise direction, cable 140 could equally be wound in a clockwise direction.

Figure 11:
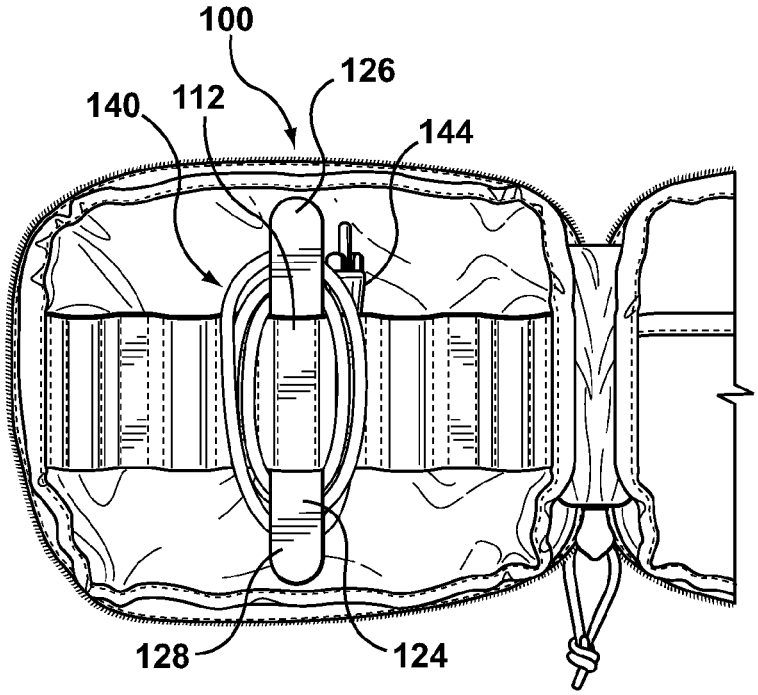

As shown in FIG. 11, once the length of cable 140 is wound around loop 112, second end 144 of cable 140 may be tucked or secured behind tab 124, within pocket 122 formed by divider 118, surface 103, and the remaining portion of fabric 114 of loop 112. Pocket 122 may thus be utilized to accommodate both ends 142, 144 of cable 140. Alternatively, second end 144 of cable 140 may be tucked or secured between windings of cable 140. With second end 144 secured, cable 140 is completely secured for storage.

Figure 12:
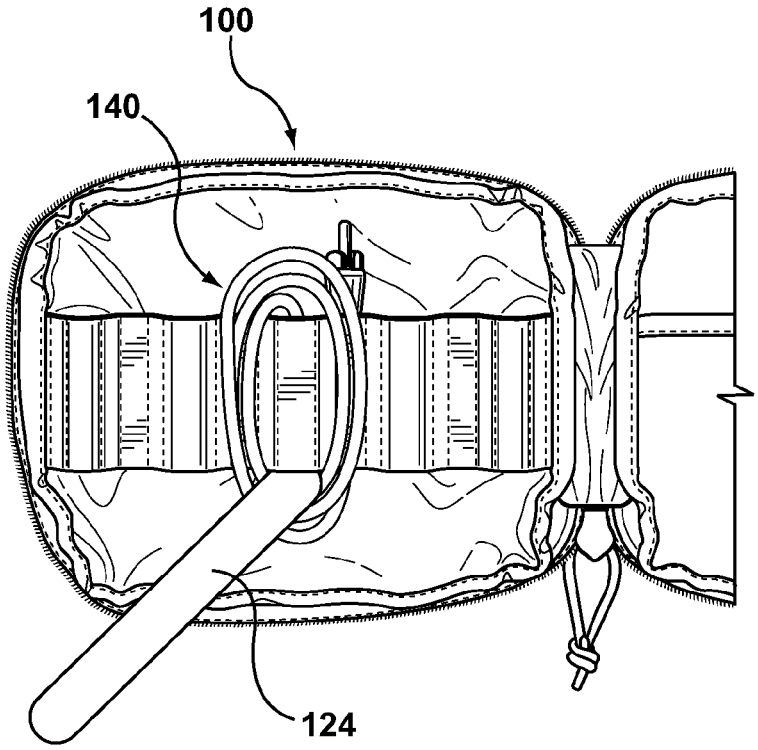
Figure 13:
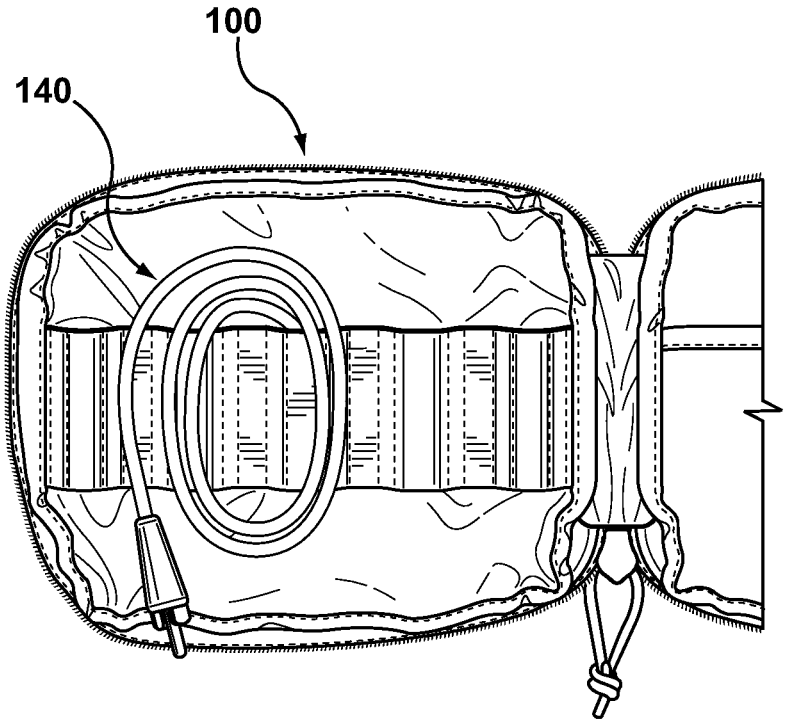

Referring now to FIGS. 12-13, tab 124 allows for quick and easy removal of cable 140 from cable organization system 100. As shown in FIG. 12, tab 124 may simply be pulled to remove it from sleeve 120. With tab 124 removed, cable 140 is released from cable organization system 100 because cable 140 is no longer pinned between tab 124 and first panel 104 of housing 102, as shown in FIG. 13. Accordingly, cable 140 may be quickly removed from cable organization system 100 and accessed by a user with just a single action of pulling tab 124. Alternatively, a user may unwind cable 140 to remove it from cable organization system 100, leaving tab 124 in place within sleeve 120 of loop 112.

While various embodiments according to the present invention have been described above, it should be understood that they have been presented by way of illustration and example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments. It will also be understood that each feature of each embodiment discussed herein, and of each reference cited herein, can be used in combination with the features of any other embodiment. All patents and publications discussed herein are incorporated by reference herein in their entirety.

What is claimed is:

1. A cable organization system comprising:

a housing having an inner surface;

a loop coupled to the inner surface, wherein the loop comprises a material with a first portion coupled to the inner surface, a second portion coupled to the inner surface, and a third portion disposed between the first and second portions and being spaced from the inner surface to form a space between the inner surface and the loop;

a divider coupled to the loop to divide the space into a sleeve and a pocket; and an elongated tab configured to fit snugly within the sleeve and being removable from the sleeve.

2. The cable organization system of claim 1, wherein the material comprises an elastic material.

3. The cable organization system of claim 1, wherein the housing is selected from the group consisting of a backpack, storage bag, sling bag, rolling case, belt pack, tote, notebook case, cover, case and display panel.

4. The cable organization system of claim 1, further comprising a cable, wherein a first end of the cable is disposed in the pocket and the remaining portion of the cable is wrapped continuously over the loop on a first side of the tab, under a first end of the tab between the tab and the inner surface, over the loop on a second side of the tab, and under a second end of the tab between the tab and the inner surface.

5. The cable organization system of claim 4, wherein a second end of the cable is disposed in the pocket.

6. The cable organization system of claim 4, wherein a second end of the cable is disposed in the pocket.

7. The cable organization system of claim 1, wherein the housing comprises a first panel and a second panel connected via a spine, wherein the first panel includes an outer surface and the inner surface, wherein the second panel comprises an outer surface and an inner surface, and wherein the first and second panels open and close in a clamshell fashion and are close via a closure mechanism.

8. The cable organization system of claim 7, wherein the closure mechanism is selected from the group consisting of a zipper, snap, button, hook and look fastener, and magnet.

9. A method of securing a cable in a housing comprising the steps of:

a) inserting an elongated tab into a sleeve in a loop attached to an inner surface of the housing, wherein the loop is formed from a material having a first portion attached to the inner surface, a second portion attached to the inner surface, and a third portion disposed between the first and second portions and spaced from the inner surface, wherein the sleeve is formed from a divider coupled to the loop and dividing a space formed between the loop and the inner surface into a pocket and the sleeve;

b) inserting a first end of the cable into the pocket;

c) extending the cable over an outside surface of the loop adjacent a first side of the tab in a first direction generally parallel to the tab;

d) wrapping the cable under a first end of the tab such that a portion of the cable is disposed between the tab and the inner surface;

e) extending the cable over the outside surface of the loop adjacent a second side of the tab opposite the first side and in a second direction generally parallel to the tab and opposite the first direction;

f) wrapping the cable under a second end of the tab such that another portion of the cable is disposed between the tab and the inner surface; and g) repeating steps c) to f) until the length of the cable is exhausted.

10. The method of claim 9, further comprising the step of inserting a second end of the cable into the pocket after step g).

11. The method of claim 9, further comprising the step of inserting the second end of the cable between windings of the cable after step g).

12. The method of claim 9, wherein the material forming the loop is a fabric material.

13. The method of claim 9, wherein the material forming the loop is an elastic material.

14. The cable organization system of claim 1, wherein the material is a fabric material.

* * * * *